US006332406B1

(12) United States Patent
Mugnier

(10) Patent No.: US 6,332,406 B1
(45) Date of Patent: Dec. 25, 2001

(54) TRANSFER SYSTEM USING SEGMENTED INTERMEDIATE SECTION

(75) Inventor: Jean Francois Mugnier, Grand Junction, CO (US)

(73) Assignee: Pomagalski S.A. (FR)

( * ) Notice: Subject to any disclaimer, the term of this patent is extended or adjusted under 35 U.S.C. 154(b) by 0 days.

(21) Appl. No.: 09/471,494

(22) Filed: Dec. 23, 1999

Related U.S. Application Data

(63) Continuation-in-part of application No. 09/408,856, filed on Sep. 30, 1999.

(51) Int. Cl.[7] ..... E01B 25/00

(52) U.S. Cl. ..... 104/130.11; 104/130.04; 104/96; 104/130.01

(58) Field of Search ..... 104/96, 93, 130.01, 104/130.04, 130.06, 130.11, 137

(56) References Cited

U.S. PATENT DOCUMENTS

| | | | | |
|---|---|---|---|---|
| 3,807,314 | * | 4/1974 | Slemmons | 104/148 R |
| 4,016,818 | * | 4/1977 | Ellzey | 104/103 |
| 4,457,235 | * | 7/1984 | Fottner | 104/104 |
| 4,476,787 | * | 10/1984 | Edwards | 104/96 |
| 4,484,526 | * | 11/1984 | Uozumi | 104/131 |
| 4,958,574 | * | 9/1990 | Meindl | 104/88 |
| 4,993,326 | * | 2/1991 | Bergemann | 104/89 |
| 5,193,767 | * | 3/1993 | Mihirogi | 246/418 |
| 5,247,890 | * | 9/1993 | Mihirogi | 104/130 |

FOREIGN PATENT DOCUMENTS

| | | | | |
|---|---|---|---|---|
| 3423 423A | | 1/1986 | (DE) . | |
| 0 369 981 | | 5/1990 | (EP) . | |
| 04161501 | * | 10/1990 | (JP) . | |
| 04161501-A | * | 10/1990 | (JP) | E01B/25/00 |
| 04161503-A | * | 6/1992 | (JP) | E01B/25/00 |
| 6 173202-A | * | 5/1994 | (JP) | E01B/25/00 |

* cited by examiner

*Primary Examiner*—S. Joseph Morano
*Assistant Examiner*—Frantz F. Jules
(74) *Attorney, Agent, or Firm*—Parkhurst & Wendel, L.L.P.

(57) ABSTRACT

A system (1) for transferring a movable load (2) for an installation (3) for conveying the load (2), and to transfer the load (2) from an arrival track (8) where the load (2) is conveyed along an entry conveying path (C), to at least first (9) and second (10) exit tracks where the load (2) is conveyed, the system (1) including a movable track section (11) adjustable for position, where the load (2) is conveyed along an intermediate conveying path, in which the section (11) includes at least two end to end track segments (16) mounted pivotally with respect to each other by a device (17) close to a junction (18) between segments (16) so that the entry, intermediate and exit conveying paths form, end to end, a conveying path whose tangent has continuous variation.

30 Claims, 6 Drawing Sheets

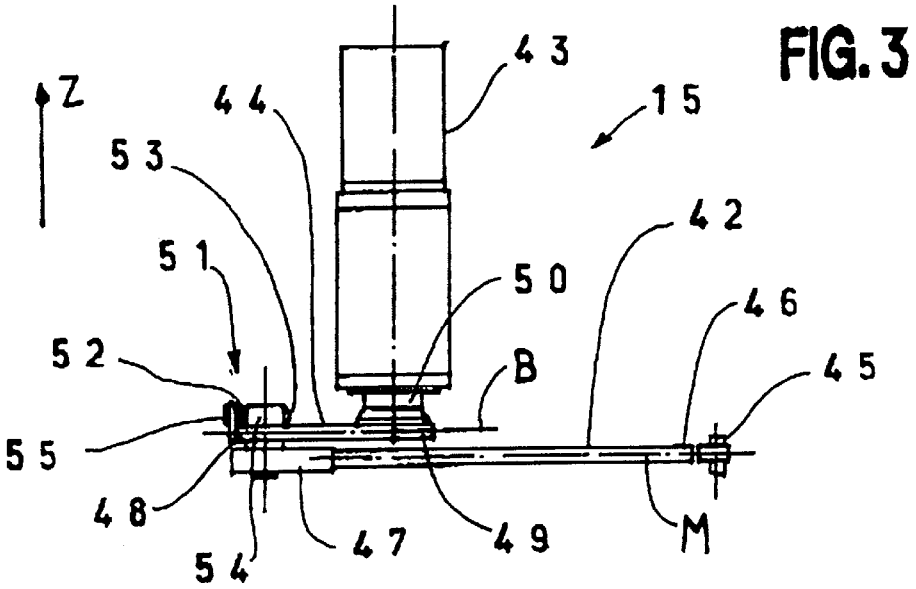
FIG. 3
Z
43
15
44
53
42
51
50
46
52
B
45
55
48
47
49
M
54
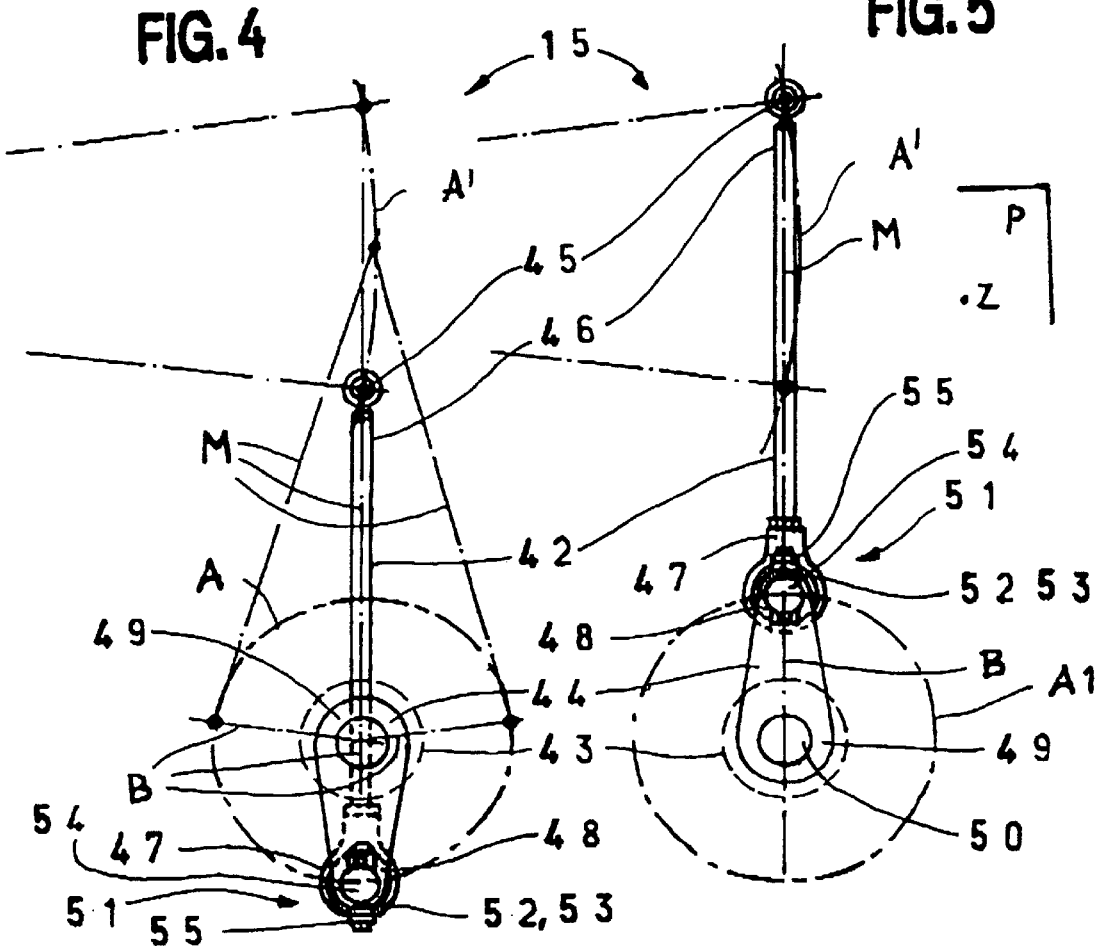
FIG. 4
FIG. 5
15
A'
A'
M
P
45
Z
46
55
M
54
51
42
47
52 53
A
49
48
B
A1
44
43
49
B
50
54
47
48
51
55
52,53

TRANSFER SYSTEM USING SEGMENTED INTERMEDIATE SECTION

This application is a C-I-P of Ser. No. 09/408,856 filed Sep. 30, 1999.

The invention relates to a transfer system for transferring a movable load for an installation conveying the said load and an overhead-cable transportation installation comprising such a system.

The invention applies in particular to conveying installations of the overhead carrier cable type, from which movable loads are suspended, such as seats or cars.

These installations generally comprise at least two end stations, for embarking and/or disembarking, where the loads are uncoupled from the cable, and then conveyed along at least one travel track which guides and supports the loads.

Such end stations can include switching points where the loads are transferred from an arrival track to several possible exit tracks.

For example, the station comprises at least a first exit track for the loads to a first embarking area, and a second exit track to a second embarking area or to an area for storing the loads.

Systems are already known for transferring movable loads to such and such an exit track, in which a straight transfer rail is interposed between the arrival track and the exit tracks and moved in alternation, like railway points, to one or other of the exit tracks, in order to match it with the arrival track.

Such systems have numerous drawbacks.

This is because the transfer rail, which is straight, cannot be adapted to the curvatures of the different exit tracks.

This results in jolts which on the one hand accelerate the wear on the installation, in particular on the travelling tracks and on the loads and their various components, which leads to a rapid deterioration of the installation and impairs the safety thereof, and on the other hand generate noises impairing the comfort of use of the installation.

Transfer systems are also known which comprise at least two transfer rails, one for each exit track, each rail being movable in order to be interposed between the entry track and the exit track corresponding to it.

These systems also have numerous drawbacks. On the one hand, these systems are heavy and bulky, and require voluminous and powerful actuation means.

On the other hand, the travel track is interrupted, at the time of changing rail, between the entry track and the transfer rail: a movable load arriving at the end of the entry track can then tilt into the void, unless a heavy and complex safety system is provided, which gives rise to a massing of the loads on the arrival track and impairs the overall throughput of the installation.

The object of the invention is to mitigate these drawbacks notably by proposing a transfer system which can be changed as required in order to be adapted to different forms of the exit tracks and thus to ensure a continuous transfer, without jolts and without interruption to the movable loads, whilst being reliable and ensuring a high continuous throughput of the installation.

SUMMARY OF THE INVENTION

To this end, and according to a first aspect, the object of the invention is a system of transferring a movable load for an installation for conveying the said load overhead, making it possible to transfer the load from a so-called arrival track, supported by a fixed frame of the installation, where the load is conveyed along a so-called entry conveying track, to at least first and second so-called exit tracks where the load is conveyed respectively on first and second so-called exit conveying paths; this system comprises a section of track which can be adjusted for position where the load is conveyed along a so-called intermediate conveying path, the exit paths having respectively first and second so-called exit radii of curvature; this section comprises a fixed end disposed opposite one end of the arrival track, and a movable end, able to be moved by an actuation device in order to be disposed opposite one end of each exit track, and comprises at least two track segments associated end to end, mounted at least pivoting with respect to each other by means of association means, disposed close to a junction between the segments, so that the entry, intermediate and exit conveying paths form end to end a conveying path whose tangent exhibits continuous variation.

According to one embodiment, the section of track comprises a rail section divided into rail segments, each track segment comprising a rail segment which has a substantially flat bottom and first and second walls substantially parallel to each other and substantially perpendicular to the bottom.

For example, the first wall is curved, and has a radius of curvature substantially equal to the first exit radius of curvature.

The second wall can also be curved, and can have a radius of curvature substantially equal to the second exit radius of curvature.

According to one embodiment, the association means are removable, so as to enable the track segment to be exchanged.

The association means comprise notably a bearing, such as a roller bearing, able on the one hand to allow the rotation of the track segments with respect to each other and on the other hand to limit the friction between the said track segments during their relative movement.

In addition, the transfer system can comprise a device for adjusting the magnitude of the relative movement of the adjacent segments.

This adjustment device can comprise, alone or in combination:

at least a first pair of pieces forming stops, disposed on each side of the junction between two track segments, a first stop in the first pair being fixed to one of the two track segments on one side of the section, a second stop in the first pair being fixed to the other track segment on the same side of the section as the first stop, opposite the latter with an adjusted separation, the stops being able to come into contact with each other when the movable end is opposite the end of the first exit track; and at least a second pair of stops, disposed on each side of the junction between two track segments, a first stop in the second pair being fixed to one of the two track segments on one side of the section, a second stop of the second pair being fixed to the other track segment on the same side of the section as the said first stop, opposite the latter with an adjusted separation, the said stops being able to come into contact with each other when the movable end is opposite the end of the second exit track.

For example, the separation between the said stops can be set by means of an adjustment device comprising an adjustable finger mounted on one of the stops in the same pair.

According to one embodiment, the transfer system also comprises means of pushing a middle part of the track section, the said pushing means being able to ensure continuous contact of the pieces in the first pair when the movable end is opposite the end of the first exit track.

For example, the pushing means comprise a spring functioning in compression, associated on the one hand with a fixed frame of the installation, and on the other hand with the said middle part of the track section.

In addition, the transfer system can comprise means of pulling a middle part of the track section, the said pulling means being able to ensure continuous contact of the stops in the second pair when the movable end is opposite the end of the second exit track.

For example, the pulling means comprise a spring operating under traction, associated on the one hand with a fixed frame of the installation and on the other hand with the said middle part of the track section.

According to one embodiment, the pushing means and the pulling means comprise one and the same spring functioning under compression when the movable end is close to the end of the first exit track, and in traction when the movable end is close to the end of the second exit track.

As for the actuation device, this comprises for example a connecting rod associated with the movable section, close to the free end of the latter.

According to one embodiment, means are provided for guiding the relative movement of the segments able to make a predetermined deformation of the movable track section possible.

These guiding means can comprise at least one articulation having a finger engaged in an oblong, for example curved, slot.

According to a provision, the articulation or each articulation is disposed on one side of the section, opposite one segment.

One articulation can be provided for each segment, except for the segment adjacent the free end of the section.

According to one embodiment, at least one articulation is disposed substantially in the middle of the corresponding segment.

In addition, at least one articulation can be disposed on one third of the length of the corresponding segment.

According to a particular embodiment, at least one finger is carried by a first arm, one end of which is fixed to the frame, whilst the corresponding slot is made in a second arm, one end of which is fixed to one of the segments.

The system can have the following characteristics, alone or in combination:

- at least one finger is carried by a first arm, one end of which is fixed to one of the segments, whilst the corresponding slot is made in a second arm, one end of which is fixed to the frame;
- at least one finger is carried by a first arm, one end of which is fixed to a segment, whilst the corresponding slot is made in a second arm, one end of which is fixed to another segment.

The finger can be situated close to a free end part of the first arm, and is, for example a socket able to slide in the slot, or a roller able to roll in the latter.

The slot can be made close to a free end part of the second arm.

This slot is, for example a through slot, with the free end part of the second aim having the form of a fork.

According to a second aspect, the object of the invention is an overhead cable transportation installation with continuous movement with uncoupling of the vehicle carried by the cable comprising a transfer system as described above.

Other objects and advantages of the invention will emerge during the following description of embodiments, the said description being given with reference to the accompanying drawings, in which:

BRIEF DESCRIPTION OF THE DRAWINGS

FIG. 3 is a side elevation view of the actuation device of the transfer system, comprising a connecting rod and a crank, in a position where the connecting rod and the crank are co-linear whilst overlapping;

FIG. 4 is a plan view of the actuation device in a position where the connecting rod and the crank are co-linear whilst overlapping so as to put the movable end of the section opposite the end of the first exit track, the axes of the connecting rod and crank being depicted in dot and dash lines in intermediate positions;

FIG. 5 is an plan view of the actuation device in a position where its connecting rod and crank are co-linear in line with each other so as to put the movable end of the section opposite the end of the second exit track;

FIGS. 1 and 2 notably depict a system 1 for transferring a movable load 2 for an overhead conveying installation 3, depicted partially in the figures.

Figure 1:
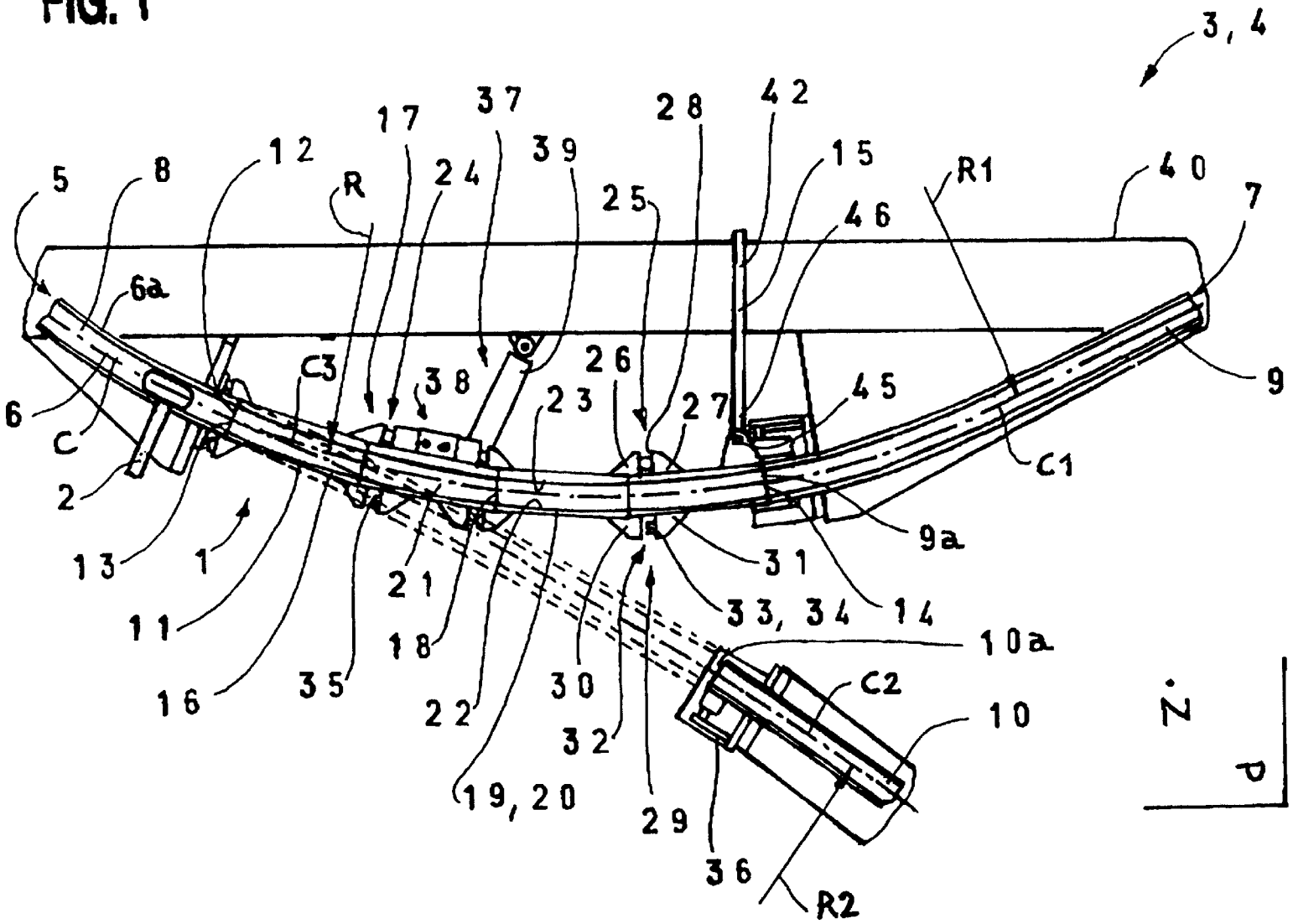
FIG. 1 is a plan view of a conveying installation comprising a transfer system for movable loads where a movable section is depicted in continuous lines in a first position where it makes it possible to transfer the loads from the arrival track to a first exit track, and broken lines in a second position where it provides the transfer of the loads from the arrival track to a second exit track.
Figure 2:
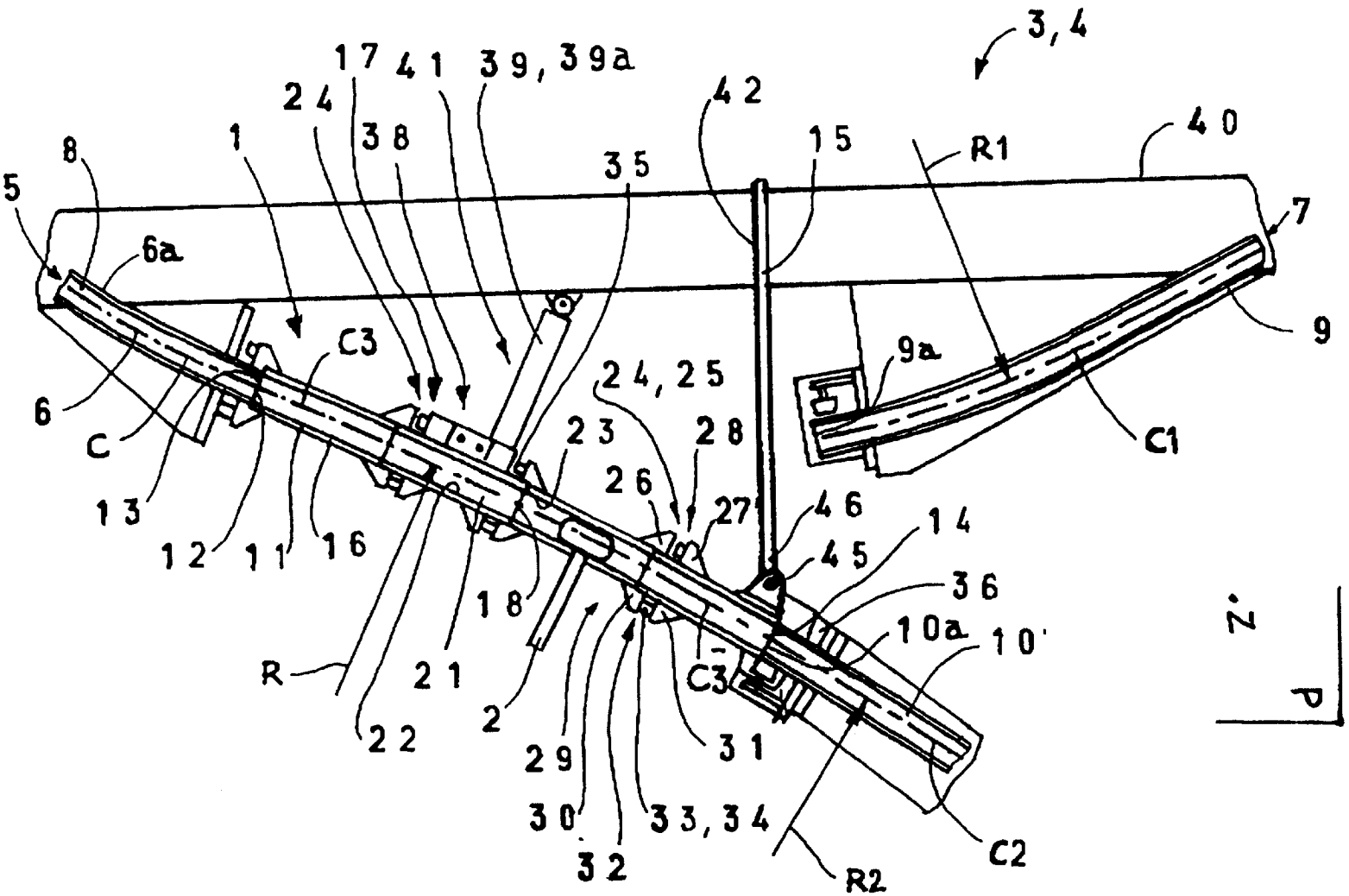
FIG. 2 is a plan view of the conveying installation of FIG. 1 where the movable section is depicted in a second position, where it makes it possible to transfer the load from the arrival track to the second exit track.

The installation 3 is for example an overhead carrying cable transportation installation with continuous movement, to which the movable load 2, notably cars or seats, are coupled by disengageable clamps.

The transfer system 1 can notably be provided for an end station 4 of the installation 3, at the entry 5 from which the loads 2 are uncoupled from the cable in order to travel on a travel track 6, and at the exit 7 from which the loads 2 are recoupled to the cable.

According to an embodiment illustrated in the figures, the travelling track 6 extends in a plane P, with respect to which the description is given, and which for more convenience is assumed to be horizontal, although the travel track can take any orientation in space.

An elevation direction Z, perpendicular to the plane P, essentially vertical, is also depicted in the Figures. The terms "top", "bottom" are defined with respect to this elevation direction.

According to one embodiment, the travel track 6 comprises a travel rail **6*a*** which has a form of channel, for example in a U-section.

Whilst the end station 4 is for example a double embarking station which comprises, at the entry 5, at least one so-called arrival track 8 where the load 2 is conveyed along a so-called entry conveying track C.

The station 4 also comprises, at the exit 7, at least a first so-called exit track 9 and a second so-called exit track 10 where the loads 2 are conveyed respectively on a first conveying path C1 and a second conveying path C2, referred to as exit paths.

According to one embodiment, the station 4 comprises a plurality of exit tracks.

The exit and arrival tracks can of course be situated at different heights and can extend in any manner in space.

For more convenience, however, it will be assumed in the remainder of the description that the tracks, both arrival and exit, are situated substantially at the same height, in the plane P.

The conveying paths C, C1, C2 are curves which lie in the plane P, the exit paths C1, C2 having, in this plane P, respectively first and second exit radii of curvature R1, R2.

Notably, the conveying paths C, C1, C2 can be continuous curves such as arcs of a circle, parabolas, hyperbolas, clothoids, or the like.

It should be stated that the radius of curvature at a point on a curve is the radius of the circle having the same curvature as its point, and which is merged locally with the curve at this point.

The transfer system 1 aims notably to transfer the loads 2 from the arrival track 8 to any one of the exit tracks 9, 10.

An embodiment is described where the transfer system 1 provides the transfer of the loads 2 from an arrival track 8 to at least two exit tracks, although provision is made for functioning also in reverse, that is to say to transfer the loads 2 from at least two tracks, notably a plurality of tracks, to a single track.

The transfer system 1 therefore makes it possible to provide a grouping of the loads 2, or a degrouping thereof.

The transfer system 1 comprises a section of movable track 11 where the objects are conveyed on a so-called intermediate conveying path C3 situated substantially in the plane P, which is a curve having in this plane an intermediate radius of curvature R.

In order to provide the transfer, the section 11 comprises a fixed end 12 fixed to a fixed frame 40 and disposed opposite an end 13 of the arrival track 8 supported by the frame 40 and a movable end 14.

This movable end 14 can be moved in the plane P by an actuating device 15, in order to be disposed opposite one end 9*a* of the first exit track 9, or opposite one end 10*a* of the second exit track 10.

So that the transfer can be effected with the minimum of jolts, the section 11 comprises at least two track segments 16 associated end to end, mounted so as to pivot, or with spherical articulation, with respect to each other, by association means 17.

For example, the track section 11 comprises a plurality of track segments 16, for example 4 to 10 track segments 16, put end to end and mounted so as to pivot with respect to each other like a bicycle chain.

According to one embodiment, the association means 17 are disposed close to a junction 18 between the segments 16, for example close to each junction 18 between two adjacent segments.

This configuration of the movable section 11 aims to provide a continuous transfer of the loads 2 from the arrival track 8 to one or other of the exit tracks 9, 10.

According to one embodiment where the travel track 6 comprises a travel rail 6*a,* the section of track 11 comprises a section of rail 19, divided into rail segments 20, provided in each of the track segments 16.

Each rail segment 20 has notably a substantially flat bottom 21 parallel to the plane P, and first and second walls 22, 23.

According to one embodiment, the walls can be substantially parallel to each other and substantially perpendicular to the base 21.

According to a variant, the walls 22, 23 are inclined with respect to the vertical, extending upwards from the bottom 21, and splaying out.

In this way, the walls 22, 23 can form, with the bottom, an obtuse angle, for example between 95 and 120 degrees.

The bottom 21 of the rail segments 20 provides the lift for the movable loads 2, whilst the walls 22, 23 provide their guidance along the intermediate conveying path C3.

According to an embodiment illustrated in FIG. 1, the exit tracks 9, 10 have opposite concavities in the plane P.

For example, the first exit conveying path C1 has a concavity turned on the same side of the travel track 6 as the entry conveying path C.

Whilst the second exit conveying path C2 has a concavity turned on the opposite side of the travel track 6, compared with the concavity of the entry conveying path C.

On the one hand, in order to provide continuous transfer from the arrival track 8 to the first exit track 9, the first wall 22 can be curved, and can have, in the plane P, a radius of curvature substantially equal to the first exit radius of curvature R1.

On the other hand, in order to provide continuous transfer from the arrival track 8 to the second exit track 10, the second wall 23 can also be curved, and can have in the plane P a radius of curvature substantially equal to the second exit radius of curvature R2.

In certain installations, the exit tracks can be replaced, for example for reasons of maintenance, by other tracks whose radii of curvature differ.

In order to adapt the movable track section 11 to the new exit tracks, provision can be made for replacing the track segments 16 with other track segments whose walls 22, 23 have radii of curvature substantially equal to those of the new exit tracks.

To this end, the association means 17 can be removable, so as to enable the track segments 16 to be exchanged.

For example, these association means 17 comprise a bearing, such as a roller bearing, turning about an axis substantially parallel to the direction Z of elevation.

Such a bearing aims on the one hand to permit the rotation of the track segments 16 with respect to each other, and on the other hand to limit the friction between these track segments 16 during their relative pivoting movement.

In order to adapt the shape of the section 16 to those of the first or second exit tracks 9, 10, the movable track section 16 comprises notably a device 24 for adjusting the amplitude of the relative movement of the adjacent segments 16.

According to an embodiment illustrated in FIG. 1, the adjustment device 24 comprises at least a first pair 25 of stops 26, 27, disposed along the section 11, on each side of the junction 18 between two track segments 16.

For example, a first stop 26 in this first pair 25 is fixed to one of the two track segments 16 on one side of the section 11, whilst a second piece 27 in the first pair 25 is fixed to the other track segment 16 on the same side of the section 11 as the first stop 26.

Whilst the second stop 27 is disposed opposite the first stop 26, the stops 26, 27 having between them a first interstice 28, a dimension of which, corresponding to the separation between the stops 26, 27, is adjusted.

The stops 26, 27 come into contact with each other when the movable end 14 of the section 11 is opposite the end 9*a* of the first exit track 9.

In an embodiment where the movable track section 11 comprises a plurality of track segments 16, the adjustment device comprises a plurality of first pairs 25 of stops.

The pairs 25 are then disposed close to each junction between two adjacent segments 16, on the same side of the section 11.

According to an embodiment illustrated in FIG. 1, the adjustment device 24 also comprises at least a second pair 29 of stops 30, 31.

These stops 30, 31 are disposed on each side of the junction 18 between the two track segments 16 along the section 11, for example symmetrically with the first pair.

A first stop 30 of the second pair 29 is then fixed to one of the two track segments 16 on the other side of the section 11, a second stop 31 in the second pair 29 being fixed to the other track segment 16 on the same side of the section as this first stop 30.

As with the first pair 25, this second stop 31 is disposed opposite the first piece 30 in accordance with an adjusted separation, the stops 30, 31 defining between them a second interstice 32, a dimension of which is substantially equal to the separation between the stops 30, 31.

The stops 30, 31 in the second pair 29 come into contact with each other when the movable end 14 is opposite the end 10*a* of the second exit track 10.

The relative movement of the segments 16 is therefore limited on the one hand by the first pair or each first pair 25 of stops 26, 27 and on the other hand by the second pair or pairs 29 of stops 30, 31.

In order to be able to adjust the magnitude of this relative movement, provision can be made for the separation of the stops 26, 27, 30, 31 to be adjustable by means of an adjustment device 33.

According to one embodiment illustrated in FIG. 1 the adjustment device comprises an adjustable finger 34 mounted on one of the stops 26, 27, 30, 31 in the same pair 25, 29.

For example, this finger 34 comprises an adjustment screw screwed into one of the stops 26, 27, 30, 31 in the same pair 25, 29 and a free end 35 of which can come into contact with the other stop in this same pair.

According to one embodiment, the transfer system 1 ensures that the movable end 14 of the section 11 is held rigidly in position when it is opposite any one of the exit tracks 9, 10.

To this end, each exit track 9, 10 can comprise, close to its respective end 9*a*, 10*a*, a device 36 for attaching the movable end 14 of the movable track section 11.

According to yet another embodiment, the transfer system 1 ensures that the contact of the stops 26, 27 in the first pair 25 is continuous, when the movable end 14 of the section 11 is opposite the end 9*a* of the first exit track 9, and maintained in position by the attachment device 36.

To this end, the transfer system 1 comprises means 37 of pushing the track section 11, notably a middle part 38 thereof.

For example, the pushing means 37 comprise a spring 39 extended substantially in the plane P, operating under compression, associated on the one hand with a fixed frame 40 of the installation 3 and on the other hand with the middle part 38 of the track section 11.

In this way, when the movable end 14 of the track section 11 is opposite the end 9a of the first exit track 9 and maintained in position by the attachment device 36, the spring 39 imparts on the section 11 a bending force which obliges it to brace itself until it is in contact with the piece forming stops 26, 27.

In addition, the transfer system 1 can comprise means 41 of pulling the middle part 38 of the track section 11.

For example, the pulling means 41 comprise a spring 39*a* extending substantially in the plane P, operating under traction, associated on one hand with the frame 40 of the installation 3 and on the other hand with the middle part 38 of the track section 11.

In this way, when the movable end 14 of the track section 11 is opposite the end 10*a* of the second exit track 10, and maintained in position by the attachment device 36, the pulling spring 39*a* imparts on the section 11 a second bending force opposite the first, which obliges it to brace itself until it is in contact with the stops 30, 31.

According to an embodiment illustrated in FIG. 1, the pushing means 37 and pulling means 41 comprise one and the same spring 39.

This spring 39 functions on the one hand under compression when the movable end 14 is close to the end 9*a* of the first exit track 9, and on the other hand under traction when the movable end 14 is close to the end 10*a* of the second exit track 10.

In addition, in order to ensure passage of the free end 14 of the section 11 from one of the exit tracks 9, 10 to the other, the actuation device 15 comprises a connecting rod 42.

This connecting rod 42 is for example associated with a movable section 11, close to the free end 14 of the latter in order to drive the latter in a controlled alternating movement passing from one of the exit tracks 9, 10 to the other.

This connecting rod 42 forms part of an assembly consisting of motor 43, connecting rod 42 and crank 44, the motor 43 being on the one hand fixed to the frame 40 and on the other hand associated with the crank 44 so as to drive the latter in a rotation movement in the plane P (FIGS. 3, 4, 5).

In addition, the connecting rod 42 is associated on the one hand with the crank 44 and on the other hand with the section 11 in order to move the latter towards each exit track 9, 10.

The connecting rod 42 and crank 44 are two rigid oblong pieces, lying respectively along a connecting rod axis B and a crank axis M, and produced for example from a metallic material such as steel.

The actuation device 15 is associated with the movable section 11 by means of a rigid rod 45, fixed to the section 11, for example by welding, close to its movable end 14.

On this rod 45 there is fitted a first end part 46 of the connecting rod 42 so that the latter is able to pivot about the rod 45 in the plane P, for example in a single direction.

A second end part 47 of the connecting rod 42 is associated with a first end part 48 of the crank 44 so that the connecting rod 42 and crank 44 are able to pivot with respect to each other in the plane P.

A second end part 49 of the crank 44 is rigidly fixed to a drive shaft 50 with its axis substantially perpendicular to the plane P, issuing from the motor 43 which, according to one embodiment, is a stepping motor.

When the motor 43 is in operation, it drives the drive shaft 50 and therefore the crank 44, in a continuous rotation movement in the plane P.

Thus, when the motor 43 is in operation, the first end part 48 of the crank 44, and the second end part 47 of the connecting rod 42 associated with it, describe in the plane P a circle A whose centre is situated on the drive shaft 50.

During this time, the first end part 46 of the connecting rod 42 describes in the plane P an arc of a circle A' whose axis is substantially merged with the fixed end of the track section 11.

The use of the assembly consisting of motor 43, connecting rod 42 and crank 44 confers a continuous movement on the section 11 without jolts, when passing from one of the exit tracks 9, 10 to the other.

In addition, in order to cause the stoppage of the movable end 14 of the section opposite the exit tracks 9, 10, the actuation device 15 can comprise a locking device 51.

This locking device 51 can control the stoppage of the motor 43 and the locking of the connecting rod 42 in a position where the movable end 14 of the section 11 is disposed opposite one of the exit tracks 9, 10.

For example, the locking device 51 comprises means 52 of detecting the relative position of the connecting rod 42 with respect to the crank 44.

According to one embodiment, the detection means 52 comprise at least two contactors 53 associated with a connection shaft 54 between the connecting rod 42 and the crank 44, at its periphery.

This connecting shaft 54 is substantially perpendicular to the axes of the connecting rod B and crank M, and is rigidly fixed to the connecting rod 42 whilst it is mounted so as to pivot with respect to the crank 44.

The first end part of the crank 44 for its part has a curved part 55 disposed opposite the connecting shaft 54 and substantially parallel to it.

This curved part 55 is disposed at a distance from the connecting shaft 54 such that it can come into contact with the contactors 53 in order to control the stopping of the motor when the movable end 14 of the track section 11 is opposite one of the exit tracks 9, 10.

The assembly consisting of motor 43, connecting rod 42 and crank 44 can be adjusted so that the movable end 14 is opposite one of the exit tracks 9, 10 when the connecting rod 42 and crank 44 are substantially co-linear, with their respective axes B, M being substantially merged.

For example, the free end 14 is opposite the end 9*a* of the first exit track 9 when the connecting rod 42 and crank 44 are substantially co-linear whilst overlapping.

Whilst the end 14 is opposite the end 10*a* of the second exit track 10 when the connecting rod 42 and crank 44 are substantially co-linear, the connecting rod 42 being in line with the crank 44.

For example, two contactors 53 are provided, associated with the connecting shaft 54 and diametrically opposed, so as to control the stoppage of the motor 43 when the connecting rod 42 and crank 44 are substantially co-linear, either overlapping, or situated in line with each other.

Figure 6:
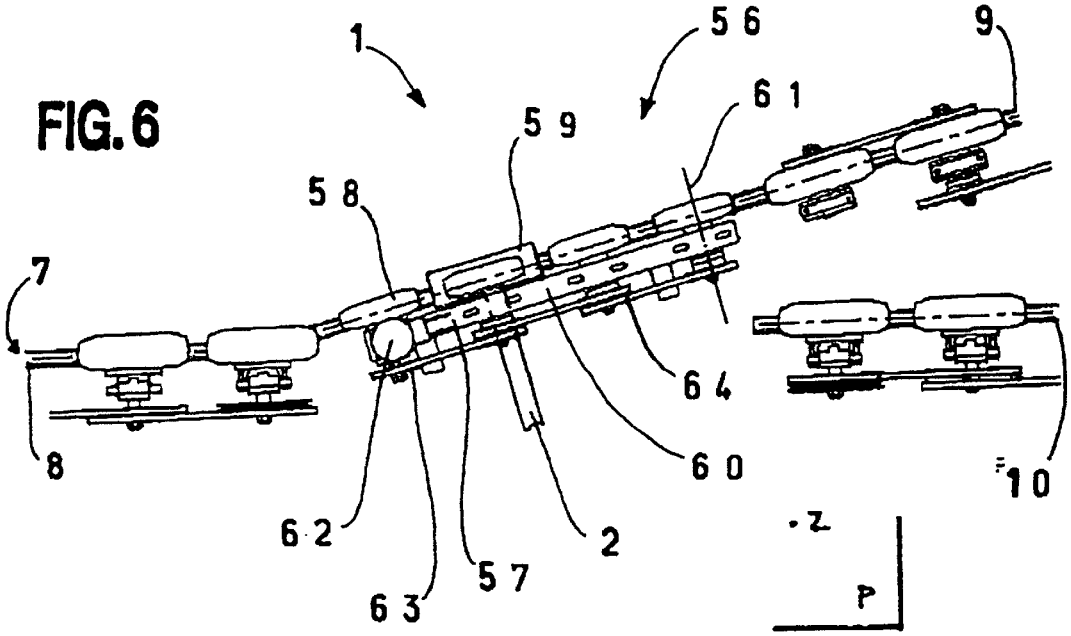
FIG. 6 is a plan view of the driving device of the transfer system of FIG. 1 in a position where it drives the movable loads from the arrival track to the first exit track.
Figure 7:
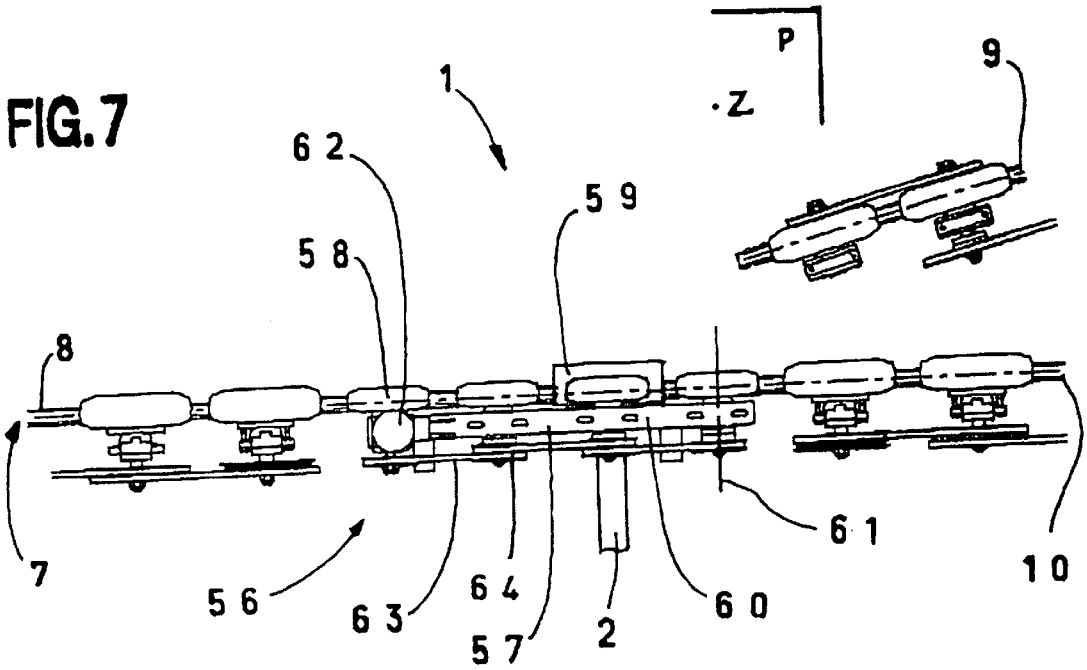
FIG. 7 is a plan view of the driving device of the transfer system of FIG. 2 in a position where it drives the movable loads from the arrival track to the second exit track.

Moreover, the transfer system 1 comprises a device 56 for driving the loads 2 along the intermediate conveying path C3 (FIGS. 6, 7).

According to a first embodiment, this driving device 56 comprises a train 57 of wheels 58 driving by friction, associated with the movable section 11 and disposed above and opposite the latter whilst being substantially parallel to it.

The wheels 58 are designed to cooperate with a substantially horizontal contact surface 59 of the load 2, in order to provide the movement thereof from the arrival track 8 as far as any one of the exit tracks 9, 10.

For example, the train 57 of wheels 58 comprises a support 60 which can be rigid, such as a section of beam, or articulated, lying in the plane P, and on which the wheels 58 are pivotally mounted.

Each wheel is mounted so as to pivot about a substantially horizontal shaft 61 perpendicular to the support 60.

The wheels 58 are driven in rotation by at least one assembly consisting of motor 62 and transmission belts 63 which can form a belt drive 64, the transmission belts 63 coming into engagement on pulleys rigidly fixed to the wheels 58.

According to one embodiment, each wheel 58 is associated with a track segment 16 and disposed above and opposite it, so that the train 57 of wheels 58 substantially follows the shape of the track section 11, whatever the position of the latter.

In particular, the train 57 of wheels 58 can then follow the shape of the track section 11 when the latter is opposite one end 9*a*, 10*a* of each exit track 9, 10. For this purpose, the support 60 can be merged with the movable track section 11.

Each wheel 58 can then be driven in rotation separately. For example, each wheel 58 is driven in rotation by a motor which is peculiar to it.

This drive device 56 makes it possible to route a load 2 along the movable section 11 whilst the end of the latter is in an intermediate position between the end 9*a* of the first exit track 9 and the end 10*a* of the second exit track 10.

According to a second embodiment, the drive device 56 comprises a drive chain able to mesh with the load 2.

This drive chain, which can be looped in an endless loop, can be disposed above the movable section 11, and is for example flexible, so as to provide continuous meshing of the load 2 along the section 11.

It is thus possible, by virtue of the invention, to combine the switching and driving of the load 2, that is to say to provide the driving of the load whilst the section 11 changes position in order to pass from one exit track to the other.

An operating mode of the transfer system 1 is now described, during the transfer of a movable load 2 from the arrival track 8 to one of the exit tracks 9, 10.

For example, two consecutive movable loads can be transferred in alternation, respectively to the first and second exit tracks 9, 10.

At the arrival of the load 2 on the arrival track, close to the end 13 thereof, the movable end of the track section 11 is moved by the actuation device towards one of the exit tracks 9, 10, for example the first exit track 9.

The load 2 then engages in the movable section 11 is routed to the first exit track 9 by the drive device 56, the wheels 58 coming into engagement successively with the contact surface of the load 2.

The load 2 is routed along the movable section 11, following the intermediate conveying path C3 which, when the movable end 14 of the section 11 is opposite the end 9*a* of the first exit track 9, has the same radius of curvature R, R1 as the first conveying path C1.

In fact, because of the centrifugal force, the load 2 comes into successive contact with the first walls 22 of the rail segments 20, which then guide the load 2 whilst defining the intermediate conveying path C3.

At the arrival of the following load 2 on the arrival track, close to the end 13 thereof, the movable end of the track section 11 is moved by the actuation device towards the other exit track, for example the second exit track 10.

The load 2 then engages in the movable section 11 and is routed to the second exit track 10 in the same way as thus described.

The load 2 is routed along the movable section 11 following the intermediate conveying path C3 which, when the movable end 14 of the section 11 is opposite the end 10*a* of the second exit track 10, has this time the same radius of curvature R, R2 as the second exit conveying path C2.

Still because of the centrifugal force, the load 2 comes into successive contact with the second walls 23 of the rail segments 20, which guide the load 2 whilst defining the intermediate conveying path C3.

Naturally, the transfer system 1 can operate in the opposite manner, in order to transfer the loads 2 from a plurality of tracks to a single track.

The structure of the transfer system 1 is then unchanged, only the drive device 56 then operating in the opposite direction.

Figure 8:
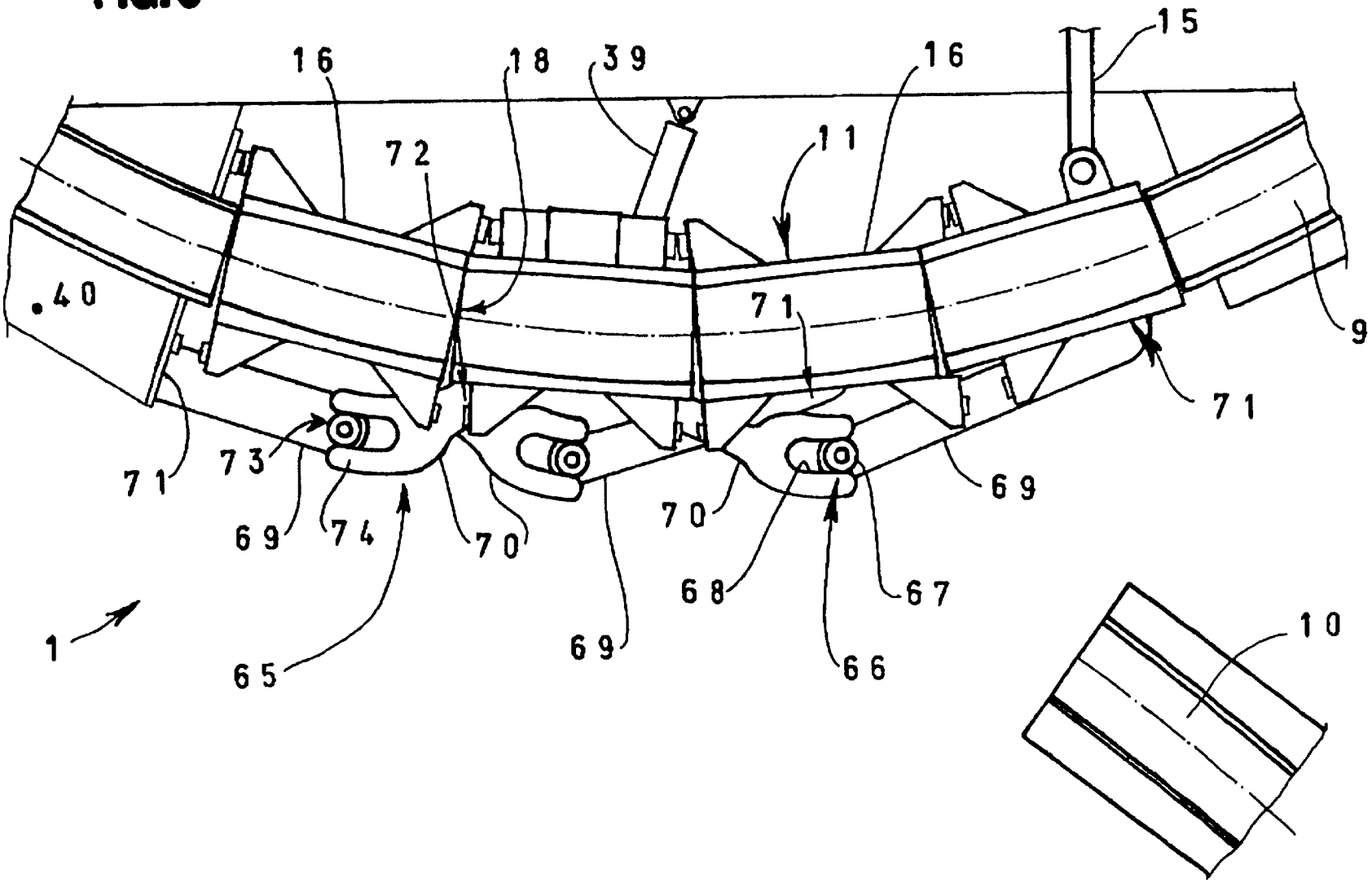
FIG. 8 is a plan view similar to FIG. 1, according to an embodiment wherein guiding means are provided for making a predetermined deformation of the section possible, where the latter is in its first position.
Figure 9:
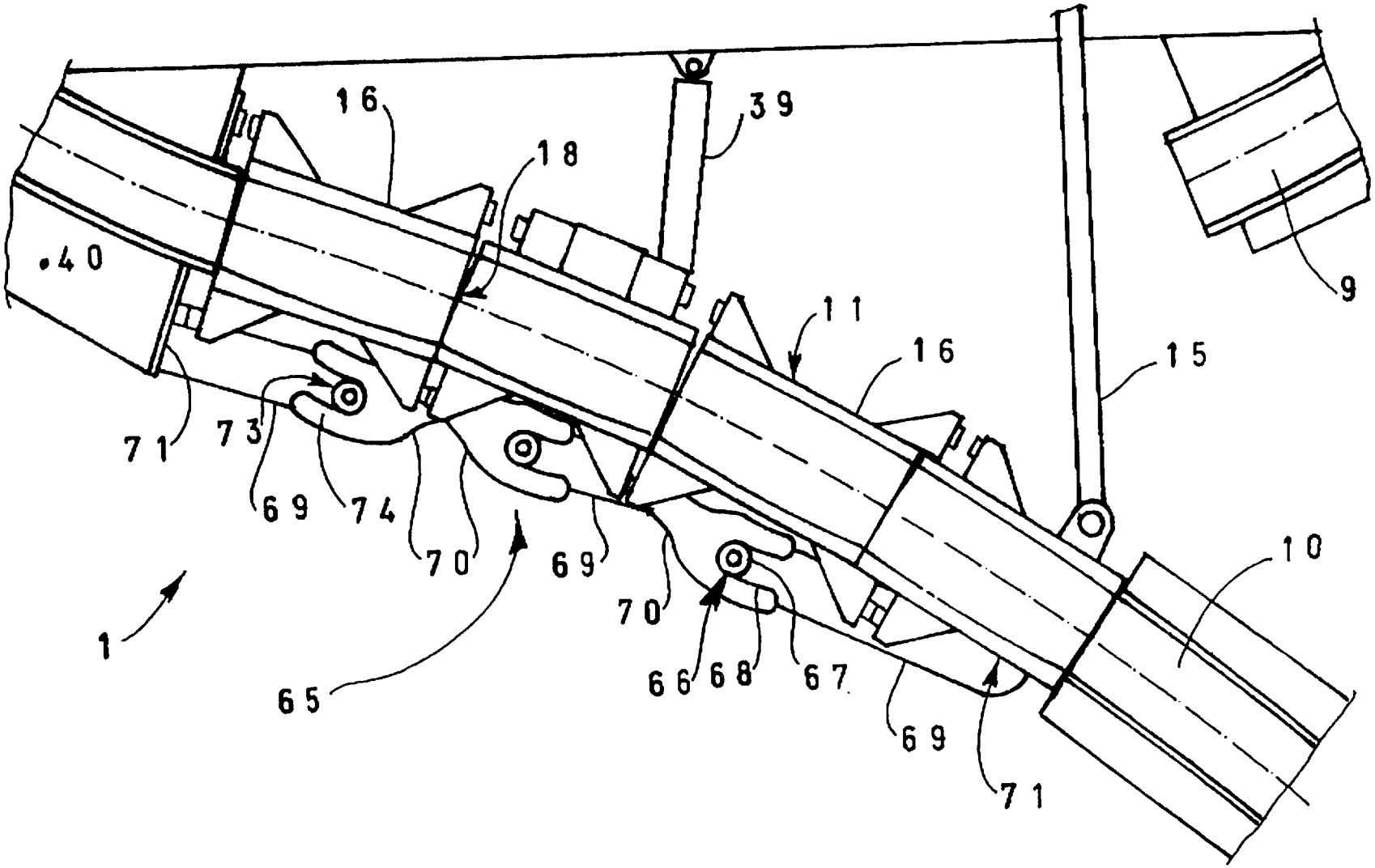
FIG. 9 is a view similar to FIG. 8, where the section is in its second position.

We are referring now to FIGS. 8 and 9.

In order to prevent the segments 16 from pivoting independently from one another and thus to prevent the section to have a broken shape, means 65 guiding the relative movement of the segments 16 can be provided.

These guiding means 65 make a predetermined deformation of the movable track section 11 possible.

To this end, the guiding means 65 comprise at least one articulation 66 which has a vertical finger 67 engaged in a horizontal oblong slot 68, which, according to an embodiment depicted on FIGS. 8 and 9, is curved.

The articulation or each articulation 66 is for example disposed on one side of the section 11, opposite a segment 16.

According to an embodiment depicted in FIGS. 8 and 9, the guiding means 65 comprise a plurality of articulations 66 disposed on the same side of the section 11, one articulation 66 being provided on each segment 16, except for the segment 16 adjacent to the mobile end 14 of the section 11 (hereinafter called free segment).

Each finger 67 is carried by a first arm 69, whilst the corresponding slot 68 is made in a second arm 70.

Arms 69, 70 extend in a substantially horizontal plane, substantially parallel to the section 11.

One of the first arms 69 is fixed to the frame 40 by one end 71, whilst the corresponding second arm 70 is fixed by one end 72 to one of the segments 16.

According to a reverse variant (not shown), the end 72 of one of the second arms 70 is fixed to the frame 40, whilst the end 71 of the corresponding first arm 69 is fixed to one of the segments 16.

As for the other first arms 69 provided, they are fixed by one end 71 to one of the rail segments 20, whilst the corresponding second arms 70 are fixed to another segment 16 by one end 72.

Each first, second arm 69, 70, respectively, thus comprises one end 71, 72 fixed to the frame 40 or to the section 11, as well as a free end part 73, 74.

Each finger is situated for example close to the free end part 73 of the first arm 69 and fixed to the latter by means of screws, welds, latches or similar.

This finger 67 can be a socket, which can then slide in the slot 68, or a roller which can then roll in the latter during the deformation of the movable track section 11, and of the relative movement of its segments 16.

In addition, the corresponding slot 68 is, for example, made close to, or within, the free end part 74 of the second arm 70.

According to an embodiment which aims to facilitate the mounting of the guiding means 65, the slot 68 is a through slot, the free end part 74 of the second arm 70 having then the shape of a fork.

For each articulation 66, the first and the second arms 69, 70 are thus disposed in line with each other, with their free end parts 73, 74 facing one another.

According to an embodiment depicted in FIGS. 8 and 9, the articulation 66 disposed opposite the segment 16 fixed to the frame 40 (hereinafter called fixed segment) is situated substantially at one third of the length of this segment 16, from the junction 18 with the adjacent segment 16, whilst the other articulations 66 are situated substantially in the middle of the length of the corresponding segments 16.

According to an embodiment, the concavity of the slot 68 is turned towards the movable track section 11.

The movement of each segment 16 depends on the movement of the other segments 16 thanks to these guiding means 65.

We shall now consider a segment 16, other than the free segment, according to the embodiment depicted in FIGS. 8 and 9.

One articulation 66 is disposed opposite this segment 16; this articulation 66 is connected, on the one hand to one of the adjacent segments by the first arm 69, and on the other hand to the other adjacent segment by the second arm 70.

The articulation 66 disposed opposite the fixed segment 16 is connected on the one hand to the frame 40 and on the other hand to the segment 16 adjacent to the fixed segment 16.

The movement of a segment 16, and in particular the free segment 16, results in a chain reaction along the section 11 via the articulations 66, which forces all the segments 16 to pivot with respect to each other according to a predetermined movement, depending on the disposition of the articulations 16, the curvature and the direction of the slots 68.

The guiding means 65 are, for example, mounted so that:

- in the first position of the section 11, where the latter is opposite the first exit track 9, the fingers 67 are situated at a first, for example free end 75 of the slot 68 (FIG. 8);
- in the second position of the section 11, where the latter is opposite the second exit track 10, the fingers 67 are situated at a second end 76 of the slot 68, for example abutting against this end 76 (FIG. 9).

What is claimed is:

1. A system (1) for transferring a movable load (2) for an installation (3) for conveying a load (2), making it possible to transfer a load (2) from a so-called arrival track (8), supported by a fixed frame (40) of the installation, where the load (2) is conveyed along a so-called entry conveying path (C), to at least first (9) and second (10) so-called exit tracks where the load (2) is conveyed respectively along first and second so-called exit conveying paths (C1, C2) having respectively first and second so-called exit radii of curvature (R1, R2), or from at least first and second tracks (9, 10) to a single track (8), the system (1) comprising a movable track section (11) adjustable for position, where the load (2) is conveyed along the so-called intermediate conveying path, the said section (11) comprising a fixed end (12) disposed opposite one end (13) of the arrival track (8), and a movable end (14), able to be moved by an actuating device (15) in order to be disposed opposite one end of each exit track (9, 10), characterised in that (a) the section (11) comprises at least two track segments (16) associated end to end, mounted at least pivotally with respect to each other by means of association means (17), disposed close to a junction (18) between the segments (16) so that the entry, intermediate and exit conveying paths form end to end a conveying path whose tangent has a continuous variation, and (b) an adjustment device (24) for adjusting the magnitude of the relative movement of the adjacent segments (16) which comprises at least a first pair (25) of pieces (26, 27) forming stops, disposed on each side of the junction (18) between the two track segments (16), a first piece (26) of the first pair (25) being fixed to one of the two track segments (16) on one side of the section (11), a second piece (27) in the first pair (25) being fixed to the other track segment (16) on the same side of the section (11) as the first piece (26), opposite the latter with an adjusted separation, the pieces (26, 27) forming a corresponding stop being able to come into contact with each other when the movable end (14) is opposite the end of the first exit track (9), and the separation between the said pieces (26, 27, 30, 31) forming the stops is adjustable by means of an adjustment device (33) comprising an adjustable finger (34) mounted on one of the pieces forming the stops in the same pair (25, 29).

2. A transfer system (1) according to claim 1, characterised in that the track section (11) comprises a rail section (19) divided into rail segments (20), each track segment (16) comprising a corresponding rail segment (20) which has a substantially flat bottom (21) and first (22) and second (23) walls substantially parallel to each other and substantially perpendicular to the bottom (21).

3. A transfer system (1) according to claim 2, characterised in that the said first wall (22) is curved, and has a radius of curvature substantially equal to the first exit radius of curvature.

4. A transfer system (1) according to claim 2, characterised in that said second wall (23) is curved and has a radius of curvature substantially equal to the second exit radius of curvature.

5. A transfer system (1) according to claim 1, characterised in that the association means (17) are removable, to enable the track segments (16) to be exchanged.

6. A transfer system (1) according to claim 1, characterised in that said association means (17) comprise a bearing able on the one hand to permit rotation of the track segments (16) with respect to each other, and on the other hand to limit friction between the said track segments (16) during their relative movement.

7. A transfer system (1) according to claim 1, characterised in that the adjustment device (24) comprises at least a second pair (29) of pieces (30, 31) forming the stops, disposed on each side of the junction (18) between the two track segments (16), a first piece (30) in the second pair (29) being fixed to one of the two track segments (16) on the other side of the section (11), a second piece (31) in the second pair (29) being fixed to the other track segment (16) on the same side of the section (11) as the said first piece (30), opposite the latter with an adjusted separation, said pieces (30, 31) forming a corresponding stop able to come into contact with each other when the movable end (14) is opposite the end of the second exit track (10).

8. A transfer system (1) according to claim 1, characterised in that the adjustment device (24) also comprises means (37) for pushing a middle part (38) of the track section (11), said pushing means (37) being able to provide continuous contact of the pieces (26, 27) in the first pair (25) when the movable end (14) is opposite the end of the first exit track (9).

9. A transfer system (1) according to claim 8, characterised in that the said pushing means (37) comprise a spring (39) operating under compression, associated on the one hand with a fixed frame (40) of the installation (3), and on the other hand with the said middle part (38) of the track section (11).

10. A transfer system (1) according to claim 1, characterised in that the adjustment device (24) also comprises means (41) for pulling a middle part (38) of the track section (11), said pulling means (41) being able to ensure continuous contact of the pieces (30, 31) in the second pair (29) when the movable end (14) is opposite the end of the second exit track (10).

11. A transfer system (1) according to claim 10, characterised in that the said pulling means (41) comprise a spring (39), operating under traction, associated on the one hand with a fixed frame (40) of the installation (3), and on the other hand with the said middle part (38) of the track section (11).

12. A transfer system (1) according to claim 10, characterised in that the pushing means (37) and the pulling means (41) comprise one and the same spring (39) operating under compression when the movable end (14) is close to the end of the first exit track (9), and under traction when the movable end (14) is close to the end of the second exit track (10).

13. A transfer system (1) according to claim 1, characterised in that the actuating device (15) comprises a connecting rod (42) associated with the movable section (11), close to the free end of the latter.

14. A transfer system (1) according to claim 1, further comprising guiding means (65) for guiding the relative movement of the segments (16), and able to make a predetermined deformation of the movable track section (11).

15. A transfer system (1) according to claim 14, characterised in that the guiding means (65) comprise at least one articulation (66) which has a finger (67) engaged in an oblong slot (68).

16. A transfer system (1) according to claim 15, characterised in that the said slot (68) is curved.

17. A transfer system (1) according to claim 15, characterised in that the articulation or each articulation (66) is disposed on one side of the section (11), opposite one segment (16).

18. A transfer system (1) according to claim 17, characterised in that one articulation (66) is provided for each segment (16), except for the segment (16) adjacent to the movable end (14) of the section (11).

19. A transfer system (1) according to claim 17, characterised in that at least one articulation (66) is disposed substantially in the middle of the corresponding segment (16).

20. A transfer system (1) according to claim 17, characterised in that at least one articulation (66) is disposed on one third of the length of the corresponding segment (16).

21. A transfer system (1) according to claim 15, characterised in that at least one finger (67) is carried by a first arm (69), one end (71) of which is fixed to the frame (40), whilst the corresponding slot (68) is made in a second arm (70), one end (72) of which is fixed to one of the segments (16).

22. A transfer system (1) according to claim 21, characterised in that the finger (67) is situated close to one free end part (73) of the first arm (69).

23. A transfer system (1) according to claim 21, characterised in that the slot (68) is made close to a free end part (74) of the second arm (70).

24. A transfer system (1) according to claim 23, characterised in that the slot (68) is a through slot, with the free end part (74) of the second arm (70) having the shape of a fork.

25. A transfer system (1) according to claim 15, characterised in that at least one finger (67) is carried by a first arm (69), one end (71) of which is fixed to one of the segments (16), whilst the corresponding slot (68) is made in a second arm (70), one end (72) of which is fixed to the frame (40).

26. A transfer system (1) according to claim 15, characterised in that at least one finger (67) is carried by a first arm (69), one end (71) of which is fixed to one segment (16), whilst the corresponding slot (68) is made in a second arm (70), one end (72) of which is fixed to another segment (16).

27. A transfer system (1) according to claim 15, characterised in that the finger (67) is a socket able to slide in the slot (68).

28. A transfer system (1) according to claim 15, characterised in that the finger (67) is a roller able to roll in the slot (68).

29. A continuously moving overhead-cable transportation installation for uncoupling of vehicles carried by the cable, characterised in that the overhead-cable transportation installation comprises a transfer system (1) according to claim 1.

30. A transfer system (1) according to claim 1, wherein the bearing is a roller bearing.

* * * * *